US008545302B2

(12) United States Patent
Wu et al.

(10) Patent No.: US 8,545,302 B2
(45) Date of Patent: Oct. 1, 2013

(54) ELECTRONIC PAPER GAME SYSTEMS AND RELATED METHODS FOR UPDATING GAME INTERFACE, AND COMPUTER PROGRAM PRODUCT THEREOF

(75) Inventors: Wen-Chin Wu, New Taipei (TW); Pin-Hsien Su, New Taipei (TW); Yao-Tsung Chang, New Taipei (TW)

(73) Assignee: Wistron Corp., New Taipei (TW)

( * ) Notice: Subject to any disclaimer, the term of this patent is extended or adjusted under 35 U.S.C. 154(b) by 0 days.

(21) Appl. No.: 13/330,586

(22) Filed: Dec. 19, 2011

(65) Prior Publication Data

US 2012/0190420 A1 Jul. 26, 2012

(30) Foreign Application Priority Data

Jan. 24, 2011 (TW) ..... 100102458 A

(51) Int. Cl.
*A63F 9/24* (2006.01)
*A63F 13/00* (2006.01)

(52) U.S. Cl.
USPC ..... 463/14; 463/30

(58) Field of Classification Search
USPC ..... 345/170, 173, 536; 455/566; 463/30, 463/37
See application file for complete search history.

(56) References Cited

U.S. PATENT DOCUMENTS

2004/0248650 A1* 12/2004 Colbert et al. ..... 463/37
2009/0107736 A1* 4/2009 Ben-Eliyahu et al. ..... 178/18.01
2009/0322696 A1* 12/2009 Yaakoby et al. ..... 345/173
2010/0113148 A1* 5/2010 Haltovsky et al. ..... 463/30
2010/0304792 A1* 12/2010 Li et al. ..... 455/566
2011/0049807 A1* 3/2011 Benty et al. ..... 273/299
2011/0084909 A1* 4/2011 Hsieh et al. ..... 345/170
2011/0090166 A1* 4/2011 Truter ..... 345/173
2011/0090234 A1* 4/2011 Bolcsfoldi et al. ..... 345/536

FOREIGN PATENT DOCUMENTS

TW 200848900 A 12/2008

OTHER PUBLICATIONS

Kindle Apps Blog, Kindle Chess, Feb. 1, 2010, http://www.kindle-apps.net/2010/02/kindle-chess/.*
Charlie Sorrel, Nook Software Update Adds Web Browser Chess, Apr. 23, 2010, http://www.wired.com/gadgetlab/2010/04/nook-software-update-adds-web-browser-chess/.*
David Carnoy, Nook update 1.3 photos, Apr. 23, 2010, http://reviews.cnet.com/2300-3508_7-10003222.html.*
Taiwan Patent Office, Office Action, Patent Application Serial No. 100102458, May 22, 2013, Taiwan.

* cited by examiner

*Primary Examiner* — Dmitry Suhol
*Assistant Examiner* — Jason Yen

(57) ABSTRACT

Electronic paper (E-paper) game systems are provided. The E-paper game system at least includes a chessboard and a plurality of chessmen. The chessboard at least includes a first E-paper display unit for displaying a graphical data of a first chessboard for a first game interface. Each of the chessmen includes a second E-paper display unit for displaying a graphical data of a first chessman which corresponds to the graphical data of the first chessboard. The chessboard and the chessmen respectively update the graphical data of the first chessboard displayed by the first E-paper display unit and the graphical data of the first chessman displayed by the second E-paper display unit to a graphical data of a second chessboard corresponding to a second game interface and a graphical data of a second chessman which corresponds to the graphical data of the second chessboard.

12 Claims, 7 Drawing Sheets

ELECTRONIC PAPER GAME SYSTEMS AND RELATED METHODS FOR UPDATING GAME INTERFACE, AND COMPUTER PROGRAM PRODUCT THEREOF

CROSS REFERENCE TO RELATED APPLICATIONS

This Application claims priority of Taiwan Patent Application No. 100102458, filed on Jan. 24, 2011, the entirety of which is incorporated by reference herein.

BACKGROUND OF THE INVENTION

1. Field of the Invention

The disclosure relates generally to game systems and related methods for updating game interfaces thereof, and, more particularly to electronic-paper game systems capable of changing multiple chess game interfaces and related methods for updating game interfaces thereof.

2. Description of the Related Art

The chess game is one kind of popular games which belongs to a leisure-longan game. Today, various kinds of playing rules and props to play chess games have been proposed and widely used around the world. Generally, a chess game may comprise a chessboard and a number of chessmen, and users or players may control the movement of the chessmen on the chessboard according to the game playing rule of each game to play the chess game. There are a certain amount of chessmen for a conventional chessboard and losing any one of them may affect the integrity of its game rule such that the game may not be continued and the lost chessman must be re-purchased. In this case, originally uncompleted set of chessmen may be discarded, both were a pity, and will waste money. In addition, one conventional chessboard may only support one specific game function. When adding multiple game functions to a single chessboard, the volume and the weight of entire chessboard will be relatively increased, thus not only occupying more spaces but also making it hard to be stored. Another way to play chess game is using an electronic chessboard to substitute for the conventional physical chessboard and all of the chessmen to play the chess game. The so-called electronic chessboard is a chessboard using a touch-sensitive screen to replace the conventional physical chessboard and all of the chessmen and utilizes the changing of the backgrounds of the program interfaces to play multiple chess games so as to generate variety entertainment chess functions on a single display interface for quickly used by users. Generally, one electronic chessboard is only suitable for one kind of game rules and the electronic chessboard only helps to record some data during playing the chess game, such as automatic time counting, automatic musical recording, automatic decision making, synchronized real-time broadcasting and so on. However, the users are not allowed to change the game content. Yet another way to play chess game is using an electronic device with a display function (e.g. the iPad). Although this method may allow the users to change the game content by software, because it has to continually supply power to the electronic device for displaying data in use, more power may be wasted. Current chessboard and chessmen typically have been manufactured by natural physical way so that the display content can not be manually changed. Moreover, the market-sold electronic chessboard is also not allowed the user to manually change the chess modes and contents.

It is therefore a desire to have a game system for supporting multiple chess games and can quickly switch the game content among all of supported chess games.

BRIEF SUMMARY OF THE INVENTION

Electronic-paper (E-paper) game systems and related methods for updating game interfaces for use in E-paper game systems are provided.

An embodiment of an E-paper game system comprises a chessboard and a plurality of chessmen. The chessboard at least comprises a first E-paper display unit for displaying a graphical data of a first chessboard for a first game interface. Each of the chessmen comprises a second E-paper display unit for displaying a graphical data of a first chessman which corresponds to the graphical data of the first chessboard, wherein the chessboard and the chessmen respectively updates the graphical data of the first chessboard displayed by the first E-paper display unit and the graphical data of the first chessman displayed by the second E-paper display unit to a graphical data of a second chessboard corresponding to a second game interface and a graphical data of a second chessman which corresponds to the graphical data of the second chessboard according to a switch signal.

In another embodiment of a method for updating game interfaces for use in an E-paper game system, at least a chessboard and a plurality of chessmen is provided to the E-paper game system, wherein the chessboard at least comprises a first E-paper display unit for displaying a graphical data of a first chessboard for a first game interface and a control unit, and wherein each of the chessmen comprises a second E-paper display unit for displaying a graphical data of a first chessman which corresponds to the graphical data of the first chessboard. When detecting a switch signal, a power is supplied to the chessboard and the chessmen and the graphical data of the first chessboard displayed by the first E-paper display unit and the graphical data of the first chessman displayed by the second E-paper display unit respectively updated to a graphical data of a second chessboard corresponding to a second game interface and a graphical data of a second chessman which corresponds to the graphical data of the second chessboard according to a switch signal. After the updating has been completed, the power supplying to the chessboard and the chessmen have been stopped.

Methods for updating game interfaces for use in an E-paper game system and related systems may take the form of a program code embodied in a tangible media. When the program code is loaded into and executed by a machine, the machine becomes an apparatus for practicing the disclosed method.

BRIEF DESCRIPTION OF THE DRAWINGS

The invention will become more fully understood by referring to the following detailed description with reference to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
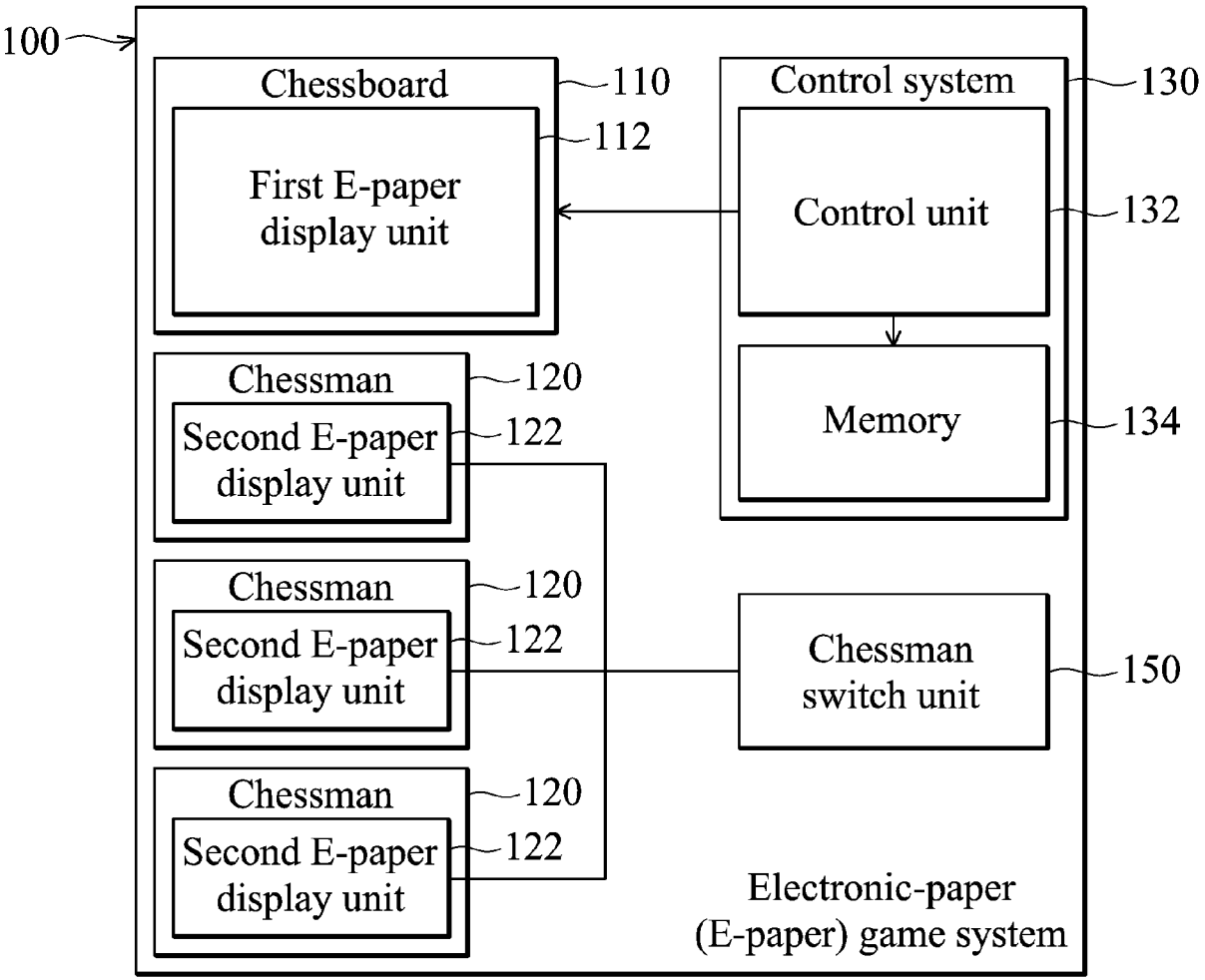
FIG. 1 is a schematic diagram illustrating a first embodiment of an electronic paper game system of the invention.

FIG. 1 is a schematic diagram illustrating a first embodiment of an electronic-paper (E-paper) game system of the invention. As shown in FIG. 1, the E-paper game system 100 at least comprises a chessboard 110 and a plurality of chessmen 120, wherein the chessmen 120 may be used to play a specific game on the chessboard 110, such as chess games, e.g. the Chinese chess, the Chess and so on. The chessboard 110 at least comprises a first E-paper display unit 112 for displaying a graphical data of a first chessboard 114 for a first game interface. Each of the chessmen 120 may further comprise a second E-paper display unit 122 for displaying a graphical data of a first chessman 124 which corresponds to the graphical data of the first chessboard 114, wherein the first E-paper display unit 112 and the second E-paper display unit 122 are display units providing E-paper features. That is, the first E-paper display unit 112 and the second E-paper display unit 122 can determine their display content by a bias voltage and when the power supply for the first E-paper display unit 112 and the second E-paper display unit 122 have been cut off and the E-papers thereof did not be changed later, with the bi-stable feature of the E-paper, their displayed data (e.g. graphical data) can still be continually displayed for a certain long time period. Detail descriptions of features and structures of the E-paper display unit will be illustrated in the following.

Figure 2A:
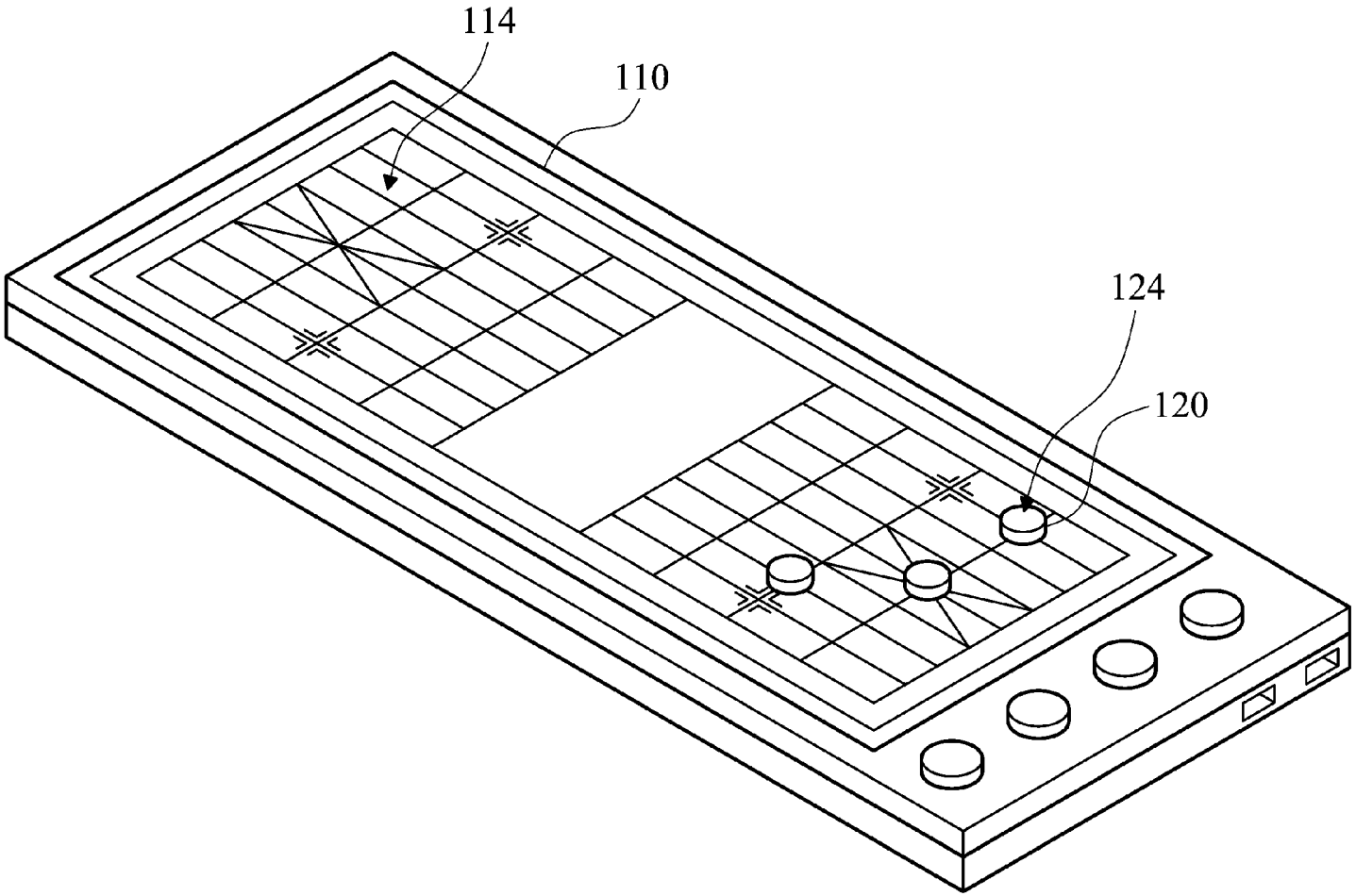
FIGS. 2A and 2B are schematic diagrams illustrating embodiments of display contents of a chessboard and a chessman of the invention respectively.

For example, if the first game interface represents a game interface of the Chinese chess, the graphical data of the first chessboard 114 displayed by the first E-paper display unit 112 is the chessboard graphical data of the Chinese chess while the graphical data of each of the first chessmen 124 displayed by the second E-paper display unit 122 is one of the chessmen graphical data corresponding to the Chinese chess, as shown in FIG. 2A. Each of the chessboard 110 and the chessmen 120 may respectively update the display data of its E-paper display unit according to a switch signal. The switch signal is used for designating a new game interface to be switched to. In other words, the chessboard 110 and each of the chessmen 120 may respectively update the graphical data of the first chessboard 114 displayed by the first E-paper display unit 112 and the graphical data of the first chessman 124 displayed by the second E-paper display unit 122 to a graphical data of a second chessboard 114' corresponding to a second game interface and a graphical data of a second chessman 124' which corresponds to the graphical data of the second chessboard 114' according to the switch signal. Detail descriptions of features and structures of the E-paper display unit and methods for updating displayed data of the E-paper display unit will be illustrated in the following with referring to FIGS. 3 to 6.

Figure 2B:
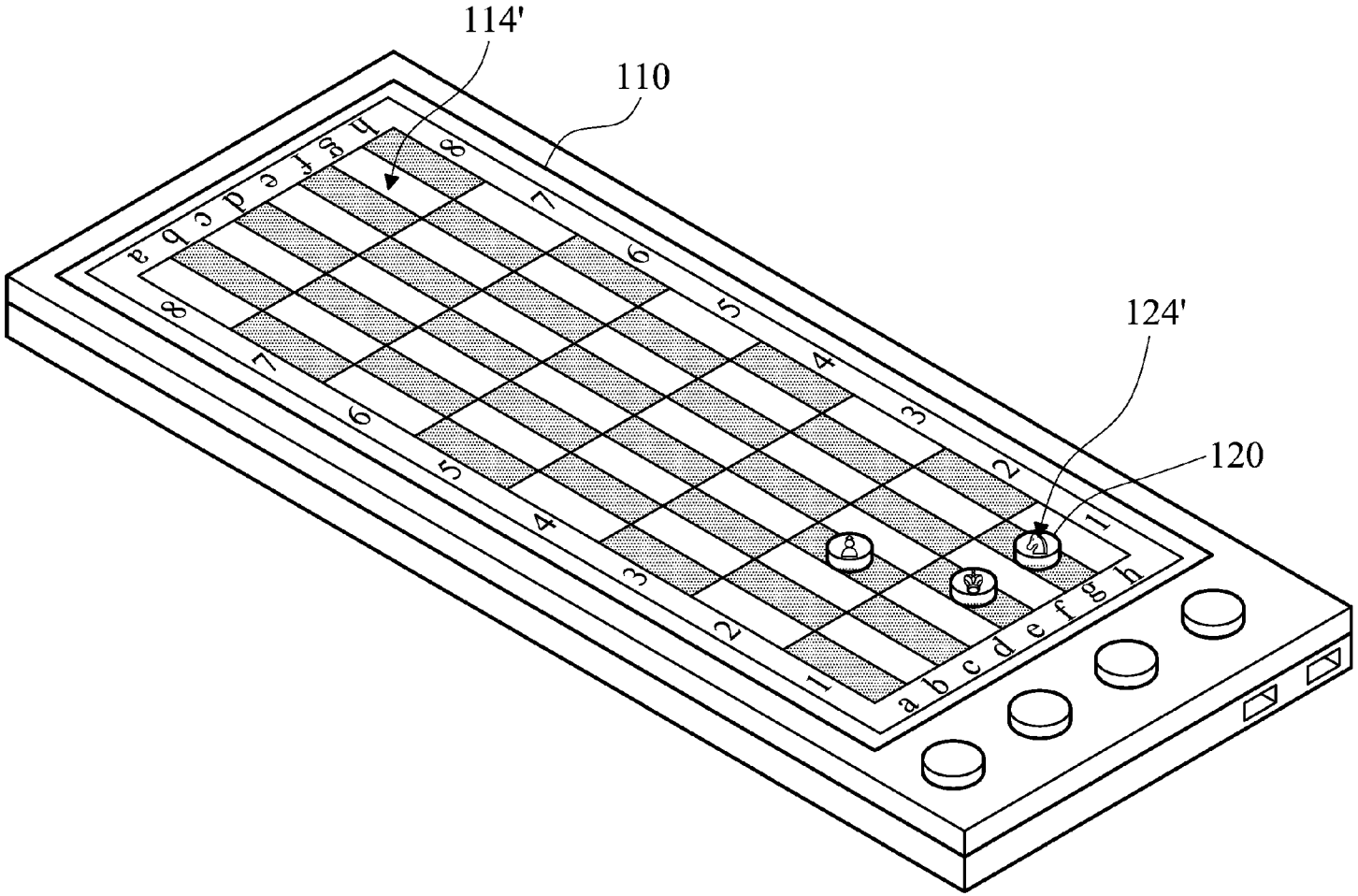

For example, if the second game interface represents a game interface of the Chess, the first E-paper display unit 112 may change its display content from the graphical data of the first chessboard 114 representing the chessboard graphical data of the Chinese chess to the graphical data of the second chessboard 114' representing the chessboard graphical data of the Chess according to a switch signal representing that it is to switch the game interface to the game interface of the Chess, such that each second E-paper display unit 112 may change its display content from the graphical data of the first chessman 114 representing the chessmen graphical data of the Chinese chess to the graphical data of the second chessman 124' representing the chessmen graphical data of the Chess, respectively, as shown in FIG. 2B.

The E-paper game system 100 may further comprise a control system 130 which includes a control unit 132 and a memory 134, wherein the memory 134 stores graphical data of chessboards and graphical data of chessmen for a number of supportable game interfaces and the control unit 132 obtains the graphical data of the second chessboard 114' and the graphical data of the second chessman 124' from the graphical data of chessboards and the graphical data of chessmen for the stored game interfaces according to the switch signal, and updates the graphical data of the first chessboard 114 displayed by the first E-paper display unit 112 to the graphical data of the second chessboard 114'.

The E-paper game system 100 may further comprise a chessman switching unit 150 for updating the graphical data of the first chessman 124 displayed by the second E-paper display unit 122 to the graphical data of the second chessman 124' according to the switch signal.

Figure 4:
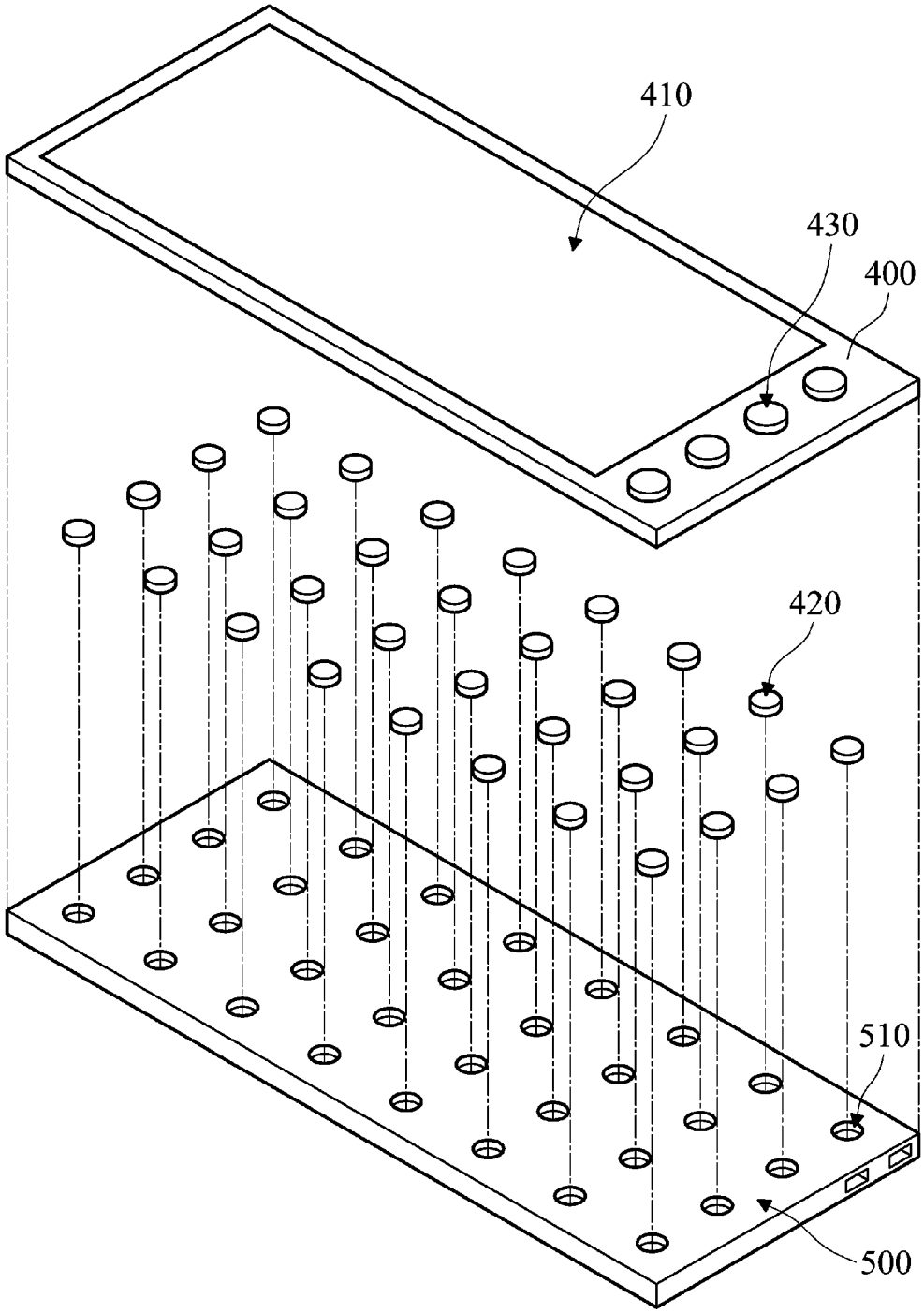
FIG. 4 is a schematic diagram illustrating a third embodiment of an arrangement of an electronic paper game system of the invention.

FIG. 4 is a schematic diagram illustrating a third embodiment of an arrangement of an electronic paper game system of the invention. In this embodiment, the E-paper game system 100 may further comprise an upper cover 400 and a bottom cover 500, wherein the chessboard 410 is deposed on the upper cover 400 and the bottom cover 500 includes a number of slots 510 corresponding to the number of the chessmen for containing all of the chessmen in which each slot 510 contains one chessman 420 of the chessman. The upper cover 400 may further comprise at least one button 430 for generating the switch signal to request for switching the game interface. Users or players may then request to switch the game interface using the button 430.

Figure 5:
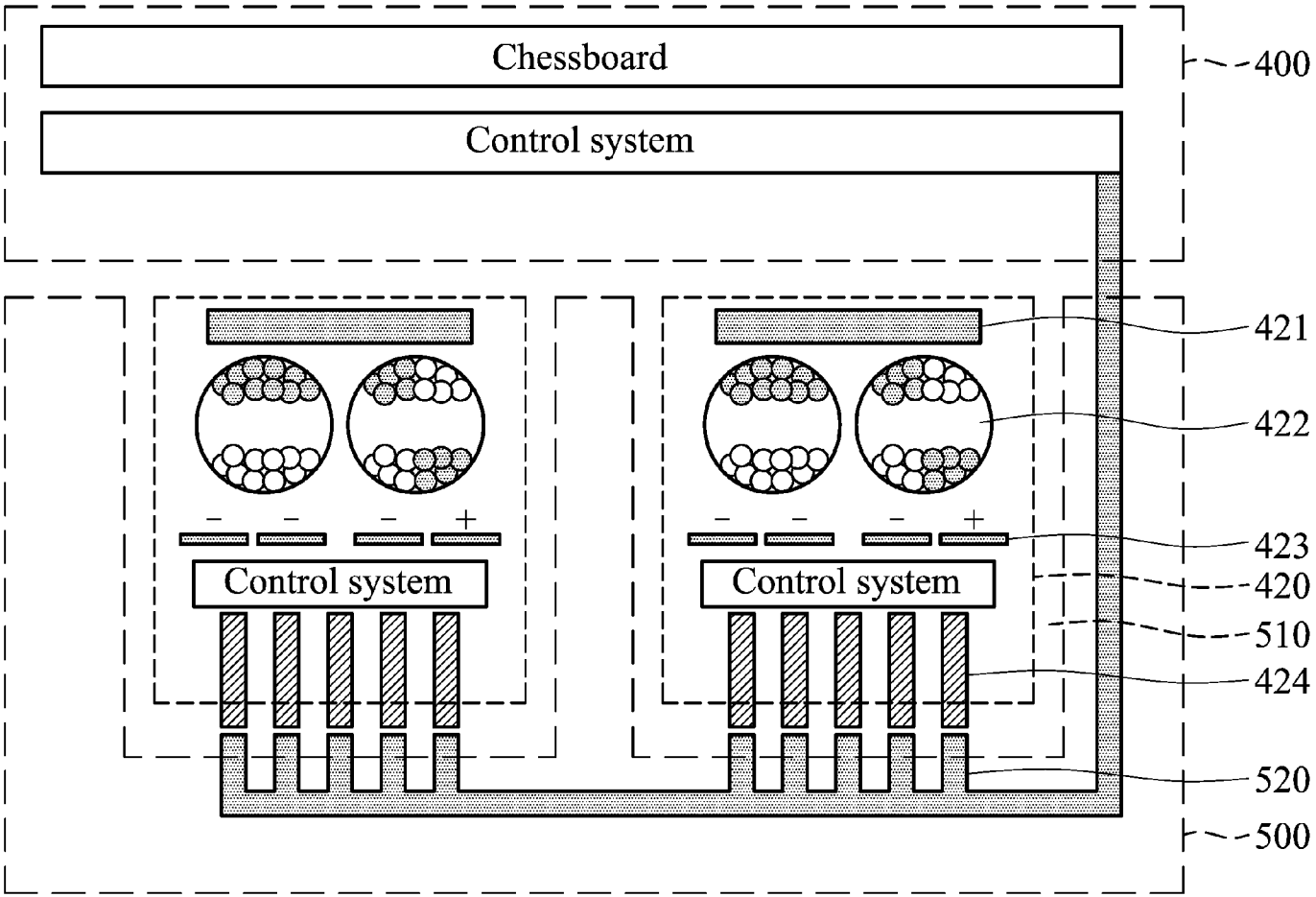
FIG. 5 is a schematic diagram illustrating a fourth embodiment of a structure of an electronic paper display unit for an electronic paper game system of the invention.

FIG. 5 is a schematic diagram illustrating a fourth embodiment of a structure of an E-paper display unit for the E-paper game system of the invention. It is to be understood that, in this embodiment, although a structure of the E-paper based on the Electronic-ink (E-ink) technology is illustrated as an example of the structure of the E-paper, but the invention is not limited thereto. Please refer to FIG. 4 and FIG. 5. As shown in FIG. 5, all of the chessmen 420 have been putted into the slots 510 on the bottom cover 500 and prepared to switch their display content displayed thereon. The upper cover 400 may further include a chessboard and a control system, wherein the chessboard includes an E-paper display unit (i.e. the first E-paper display unit) whose content can be changed by a bias voltage provided by the control system (e.g. the control system 130 shown in FIG. 1). Moreover, the structure of the E-paper display unit (i.e. the second E-paper display unit) of each chessman 420 may consist of a transparent electrode 421, an E-ink 422, a control electrode 423, a control system and a connection interface 424, wherein the connection interface 424 includes a plurality of contact points which connect to a plurality of responsive contact points within a connector 520 of the bottom cover 500, respectively. When the upper cover 400 and the bottom cover 500 are jointed, the control system within the bottom cover 500 is electronically connected to the control system within the upper cover 400 to receive a control signal issued by the control system within the upper cover 400, such that the control system within the each chessman 420 generates desired gray-level variation by changing of the electrodes between the transparent electrode 421 and the non-transparent control electrode 423 to control the movement of the display media within the microcapsules electrode 421 of the E-ink, so as to update the data displayed by its E-paper display unit.

In the structure of E-paper display unit shown in FIG. 5, because each chessman 420 at least comprises one control system and one control electrode 423, this structure of which is more complicated and a connection interface with multiple contact points is necessary, thereby highly increasing the production costs and making the connection among the contact points becomes not so easy. In some embodiments, an enhanced structure of the E-paper display unit for a chessman is further provided to reduce the production costs and increasing the convenience in use.

Figure 6:
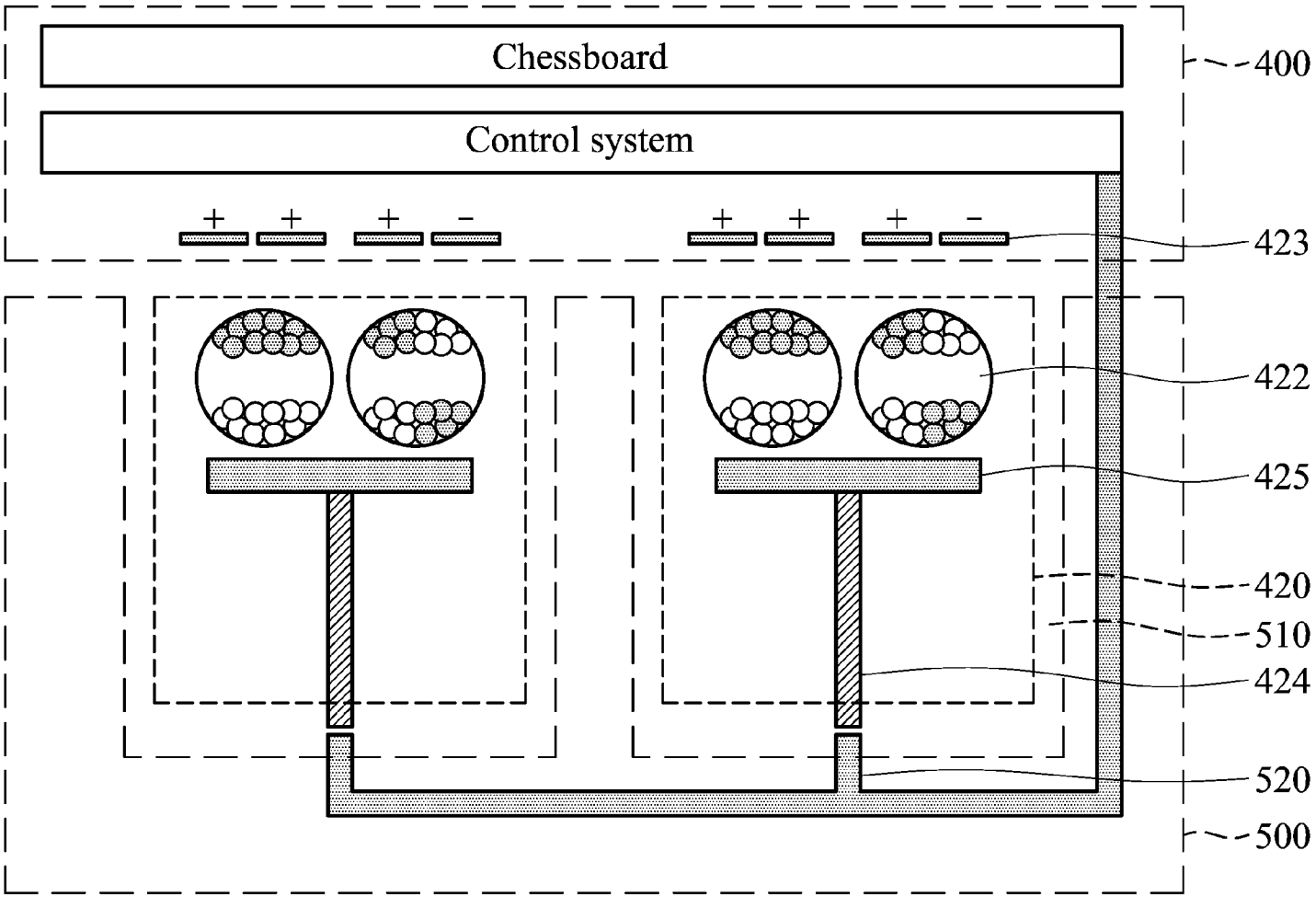
FIG. 6 is a schematic diagram illustrating a fifth embodiment of a structure of an electronic paper display unit for an electronic paper game system of the invention.

Please refer to FIG. 6. FIG. 6 is a schematic diagram illustrating a fifth embodiment of a structure of an E-paper display unit for the E-paper game system of the invention. As shown in FIG. 6, in addition to a chessboard and a control system, the upper cover 400 may further comprise a control electrode 423. Similarly, the chessboard includes an E-paper display unit (i.e. the first E-paper display unit) whose content can be changed by a bias voltage provided by the control system. Moreover, the structure of E-paper display unit (i.e. the second E-paper display unit) of each chessman 420 may consist of an E-ink 422, a ground electrode 425 and a connection interface 424, wherein the connection interface 424 includes only single contact point to connect to the single contact point within the connector 520 of the bottom cover 500 to form a ground. In this embodiment, when the upper cover 400 and the bottom cover 500 are jointed, the control system within the upper cover 400 may control the movement of the display media within the microcapsules of E-ink 422 to generate desired gray-level variation by controlling the polarity of the control electrode 423 and the ground electrode 425 to control the upper and bottom electrodes of the E-ink 422 of the chessman 420, so as to update the data displayed by its E-paper display unit. As shown in FIG. 6, the control electrode 423 and the E-ink 422 are deposed separately in the enhanced E-paper structure and thus the chessman 420 only consists of the E-ink 422 and a ground electrode 425 while it does not consist of the control electrode 423, wherein the control electrode 423 is deposed on different position (e.g. be deposed on the upper cover 400). In the structure of the E-paper display unit shown in FIG. 6, because the control electrode 423 is deposed on the upper cover 400, there is no need for controlling by the control system in each chessman 420, thereby simplifying the structure of the chessman 420. Furthermore, the single contact point design makes the chessman easily and conveniently be putted into the responsive slots and durability in use.

Figure 3:
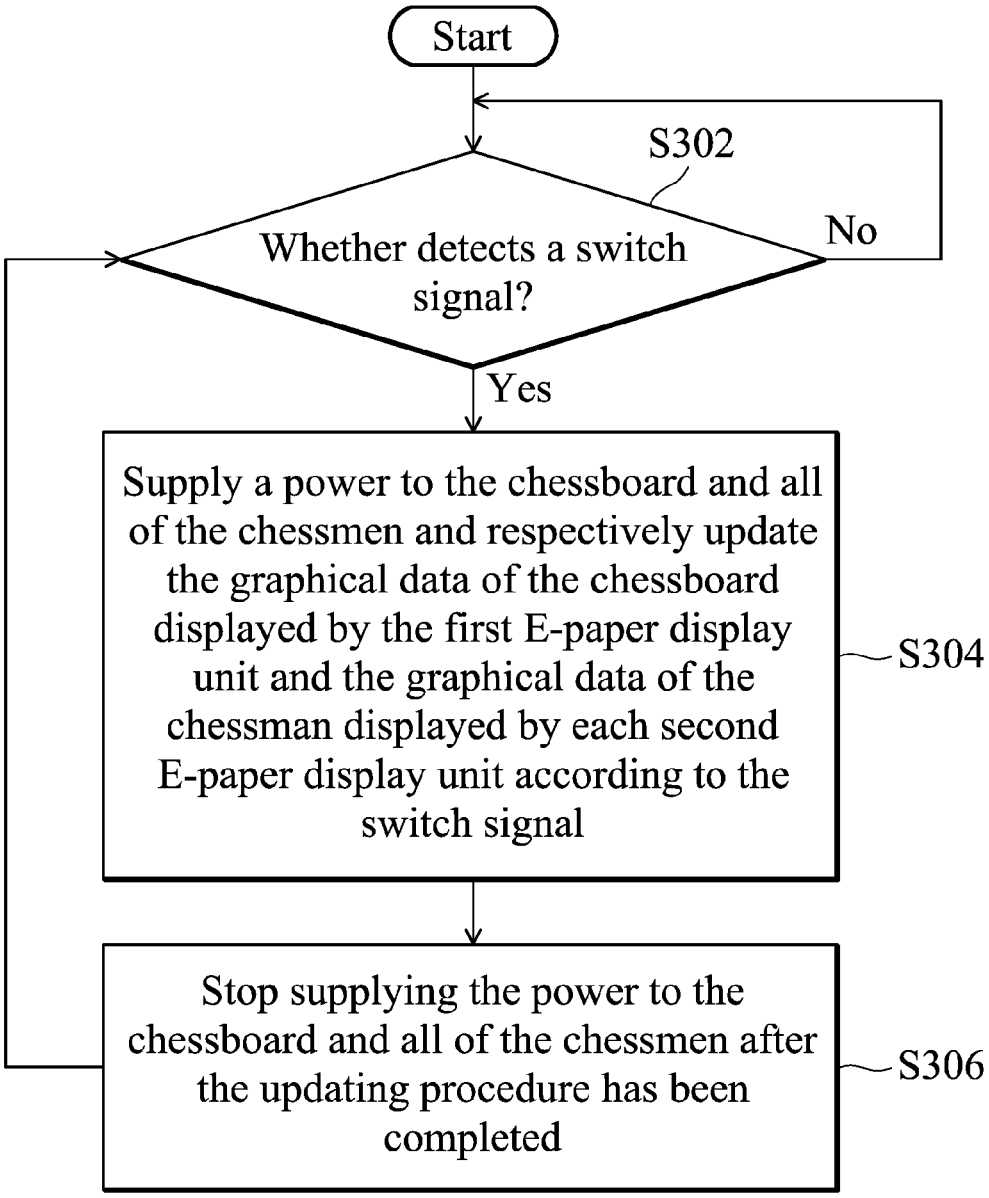
FIG. 3 is a flowchart of a second embodiment of a method for updating game interface of the invention.

FIG. 3 is a flowchart of a second embodiment of a method for updating game interfaces of the invention. The method for updating game interfaces of the invention is suitable for use in the E-paper game system 100 as shown in FIG. 1. The E-paper game system 100 at least comprises a chessboard 110 and a plurality of chessmen 120, wherein the chessboard 110 at least comprises a first E-paper display unit 112 for displaying a graphical data of a first chessboard 114 for a first game interface and each chessman 120 may further comprise a second E-paper display unit 122 for displaying a graphical data of a first chessman 124 which corresponds to the graphical data of the first chessboard 114. In this embodiment, it is assumed that the power of the control system 130 is set in a power-off mode or a power-saving mode at initial.

First, in step S302, it is determined whether a switch signal has been detected. In one embodiment, the chessboard 110 may further comprise a number of keys, wherein at least one hotkey is used for generating the switch signal to represent which game interface is to be switched to. When a user attempts to switch the game interface, the hotkey will be pressed. Meanwhile, the E-paper game system 100 will detect a switch signal. If no switch signal has been detected, which means that the display contents of the chessboard and each chessman are kept without any updating required, the flow returns to step S302 to continually detect whether any switch signal is generated. In this case, the power of the control system 130 is still set in the power-off mode or the power-saving mode. If any switch signal has been detected, which means that the display contents of the chessboard and each chessman are to be updated, in step S304, a power is supplied to the chessboard 110 and the chessman 120, and the graphical data of the first chessboard displayed by the first E-paper display unit 112 and the graphical data of the first chessman displayed by the second E-paper display unit 122 are respectively updated according to the switch signal. Meanwhile, the operation state of the control system 130 will be switched from the power-saving mode to the normal power-up mode. In this step, it is assumed that the memory 134 of the E-paper game system 100 has stored a number of supportable chess game interfaces data, each of chess game interfaces data comprising the chessboard graphical data and corresponding chessmen graphical data thereof. In this case, the E-paper game system 100 may obtain a responsive chess game interface data from the memory 134 according to the switch signal and update the graphical data of chessboard and the graphical data of chessman displayed by the first E-paper display unit 112 and the second E-paper display unit 122, respectively.

For example, assume that a system arrangement of a E-paper game system as shown in FIG. 4 and a structure of an E-paper as shown in FIG. 6 are applied to the E-paper game system 100. That is, the E-paper game system 100 may further comprise an upper cover 400 and a bottom cover 500, wherein the chessboard 410 is deposed on the upper cover 400 and the bottom cover 500 includes a number of slots 510 corresponding to the number of the chessmen for containing all of the chessmen in which each slot 510 contains one chessman 420 of the chessman. The upper cover 400 may further comprise at least one button 430 for generating the switch signal. In addition to a chessboard 410 and a control system, the upper cover 400 may further comprise a control electrode 423. Similarly, the chessboard 410 includes an E-paper display unit (i.e. the first E-paper display unit 112). Moreover, the structure of E-paper display unit (i.e. the second E-paper display unit 122) of each chessman 420 may consist of an E-ink 422, a ground electrode 425 and a connection interface 424, wherein the connection interface 424 includes only single contact point to connect to the single contact point within the connector 520 of the bottom cover 500 to form a ground. It is also assumed that the game interface of the E-paper game system 100 is a game interface of the Chinese chess, such that the first E-paper display unit 112 and the second E-paper display unit 122 respectively display the chessboard graphical data of the Chinese chess and the chessmen graphical data corresponding to the Chinese chess (as shown in FIG. 2A). When the switch signal represents that a game interface of the Chess is to be updated, the control unit 132 may obtain the graphical data of the second chessboard 114' and the graphical data of the second chessman 124' from the graphical data of chessboards and the graphical data of chessmen for the stored game interfaces according to the switch signal, and put the chessmen to be updated into the slots 510 of the bottom cover 500 to prepare for performing a updating procedure. Thereafter, when the upper cover 400 and the bottom cover 500 are jointed, the control system within the upper cover 400 may provide a bias voltage to change the displayed content of the first E-paper display unit 112 and may further control the movement of the display media within the microcapsules of E-ink 422 to generate desired gray-level variation by controlling the polarity of the control electrode 423 and the ground electrode 425 to control the upper and bottom electrodes of the E-ink 422 of the chessman 420 at the same time, so as to update the data displayed by the second E-paper display unit 122. Detail descriptions regarding how to control the movement of the display media within the microcapsules of E-ink 422 to generate desired gray-level variation by the bias voltage are well-known in the art, and thus are omitted here for brevity.

Therefore, the first E-paper display unit 112 and the second E-paper display unit 122 may respectively update their display content to the chessboard graphical data of the Chess and the chessmen graphical data of the Chess (as shown in FIG. 2B).

After the updating has been completed, in step S306, due to property of the E-paper, the power supplied to the chessboard and the chessmen can be stopped such that the power of the control system 130 is set in the power-off mode or the power-saving mode again. In this case, the first E-paper display unit 112 and the second E-paper display unit 122 can still keep displaying the updated graphical data of the chessboard and the updated graphical data of each chessman, respectively, even if the power supplied to the chessboard and the chessmen have been stopped.

In some embodiments, when the data displayed by the second E-paper display units of one or more chessmen are to be updated/switched, the updating/switching procedure can be performed on one of the chessmen at one time or on all of the chessmen at the same time. If only the data displayed by the second E-paper display unit(s) of one of or a portion of the chessmen 420 are to be updated/switched, the power can be supplied to only the chessmen 420 which is to be updated/switched. If the data displayed by the second E-paper display units of all of the chessmen 420 are to be updated/switched, all of the chessmen can be putted into responsive slots 510 on the bottom cover 500 to be changed at the same time. For example, after all of the chessmen 420 have been putted into the responsive slots 510 on the bottom cover 500, the surfaces of all of the chessman which display responsive graphical data can be jointly turned upward so that when the upper cover 400 is jointed, the control system within the upper cover 400 may control the movement of the display media within the microcapsules of the E-ink 422 to generate desired gray-level variation by controlling the polarity of the control electrode 423 and the ground electrode 425 to control the upper and bottom electrodes of the E-ink 422 of the chessman 420, so as to update the data displayed by each E-paper display unit.

In summary, according to the E-paper game system and related methods for up dating game interfaces of the invention, because display data of the chessboard and each chessman are both displayed by the E-paper display units, the power of the control system can be turned off or be set in the power-saving mode if the E-paper display unit thereof are not used, such that the control unit and the display units are powered off or set in the power-saving mode in most of the time, thereby efficiently saving power consumption and suitably utilizing in providing long time power supply with batteries. Additionally, an enhanced E-paper chessmen design is further provided to efficiently reduce the required production costs. Moreover, as both the chessboard and each chessman are displayed by using the E-paper display units, the responsive display content displayed by each E-paper display unit can be easily updated by supplying a certain power thereto and a hotkey is further provided to quickly assign the chess game interface to be updated such that the E-paper game system can easily switch from one chess game interface to another, conveniently replace/generate new chessman, and support multiple chess games, thereby providing a variety of ways to play chess games for users. Furthermore, as physical chessboard and chessmen are utilized to play certain chess game on the electronic chessboard without having to change behaviors of the traditional chess players, making a more realistic game for the user.

Methods and systems thereof, or certain aspects or portions thereof, may take the form of a program code (i.e., executable instructions) embodied in tangible media, such as floppy diskettes, CD-ROMS, hard drives, or any other machine-readable storage medium, wherein, when the program code is loaded into and executed by a machine, such as a computer, the machine thereby becomes an apparatus for practicing the methods. The methods may also be embodied in the form of a program code transmitted over some transmission medium, such as electrical wiring or cabling, through fiber optics, or via any other form of transmission, wherein, when the program code is received and loaded into and executed by a machine, such as a computer, the machine becomes an apparatus for practicing the disclosed methods. When implemented on a general-purpose processor, the program code combines with the processor to provide a unique apparatus that operates analogously to application specific logic circuits.

While the invention has been described by way of example and in terms of preferred embodiment, it is to be understood that the invention is not limited thereto. Those who are skilled in this technology can still make various alterations and modifications without departing from the scope and spirit of this invention. Therefore, the scope of the present invention shall be defined and protected by the following claims and their equivalents.

What is claimed is:

1. An electronic-paper game system, comprising:

a chessboard, at least comprising a first electronic-paper display unit for displaying a graphical data of a first chessboard for a first game interface; and a plurality of chessmen, each of the plurality of chessmen comprising a second electronic-paper display unit for displaying a graphical data of a first chessman which corresponds to the graphical data of the first chessboard, wherein the chessboard and the plurality of chessmen respectively updates the graphical data of the first chessboard displayed by the first electronic-paper display unit and the graphical data of the first chessman displayed by the second electronic-paper display unit to a graphical data of a second chessboard corresponding to a second game interface and a graphical data of a second chessman which corresponds to the graphical data of the second chessboard according to a switch signal, wherein each of the plurality of chessmen is physically put on the chessboard to play a game on the chessboard.

2. The electronic-paper game system as claimed in claim 1, further comprising:

a memory, storing graphical data of chessboards and graphical data of chessmen for a plurality of game interfaces; and a control unit, obtaining the graphical data of the second chessboard and the graphical data of the second chessman from the graphical data of chessboards and the graphical data of chessmen for the game interfaces according to the switch signal, and updating the graphical data of the first chessboard displayed by the first electronic-paper display unit to the graphical data of the second chessboard.

3. The electronic-paper game system as claimed in claim 2, further comprising a chessman switching unit for updating the graphical data of the first chessman displayed by the second electronic-paper display unit to the graphical data of the second chessman according to the switch signal.

4. The electronic-paper game system as claimed in claim 3, further comprising a upper cover and a bottom cover, wherein the chessboard is deposed on the upper cover and the bottom cover includes slots corresponding to the number of the plurality of chessmen for containing all of the plurality of chessmen.

5. The electronic-paper game system as claimed in claim 4, wherein the upper cover further comprises at least one button for generating the switch signal.

6. The electronic-paper game system as claimed in claim 5, wherein all of the plurality of chessmen are put into the slots for switching at the same time when data displayed by the second electronic-paper display units of all of the plurality of chessmen are to be switched.

7. The electronic-paper game system as claimed in claim 5, wherein the chessman switching unit further updates the data displayed by the second electronic-paper display unit of one of the plurality of chessmen.

8. The electronic-paper game system as claimed in claim 4, wherein the upper cover further includes a control system and the second electronic-paper display unit of each chessman further includes a transparent electrode, a E-ink, a control electrode, a control system and a connection interface, wherein the connection interface includes a plurality of contact points connecting contact points within a connector of the bottom cover respectively, wherein the first electronic-paper display unit of the chessboard is provided a bias for changing displayed data of the first electronic-paper display unit through the control system within the upper cover, and when the upper cover and the bottom cover are jointed, the control system within the bottom cover is electronically connecting to the control system within the upper cover for receiving a control signal issued by the control system within the upper cover such that the control system within the each chessman controls the E-ink of the chessman to update the data displayed by the second electronic-paper display unit through the transparent electrode and the control electrode.

9. The electronic-paper game system as claimed in claim 4, wherein the upper cover further includes a control system and a control electrode, and the second electronic-paper display unit of each chessman further includes a E-ink and a ground electrode, wherein when the upper cover and the bottom cover are jointed, the control system within the upper cover controls the E-ink of the chessman to update the data displayed by the second electronic-paper display unit through the control electrode and the ground electrode.

10. The electronic-paper game system as claimed in claim 9, wherein the plurality of chessman further includes a connection interface with a single contact point for connecting a ground electrode of the slots.

11. A method for updating game interfaces for use in an electronic-paper game system, comprising:

providing the electronic-paper game system at least a chessboard and a plurality of chessmen, wherein the chessboard at least comprises a first electronic-paper display unit for displaying a graphical data of a first chessboard for a first game interface and a control unit, and wherein each of the plurality of chessmen comprises a second electronic-paper display unit for displaying a graphical data of a first chessman which corresponds to the graphical data of the first chessboard;

when detecting a switch signal, supplying a power to the chessboard and the plurality of chessmen and respectively updating the graphical data of the first chessboard displayed by the first electronic-paper display unit and the graphical data of the first chessman displayed by the second electronic-paper display unit to a graphical data of a second chessboard corresponding to a second game interface and a graphical data of a second chessman which corresponds to the graphical data of the second chessboard according to a switch signal; and stopping supplying the power to the chessboard and the plurality of chessmen after the updating has been completed, wherein each of the plurality of chessmen is physically put on the chessboard to play a game on the chessboard.

12. A non-transitory-machine-readable storage medium comprising a computer program, which, when executed, causes a device to perform a method for updating game interfaces for use in an electronic-paper game system, the electronic-paper game system at least comprising a chessboard and a plurality of chessmen, wherein the chessboard at least comprises a first electronic-paper display unit for displaying a graphical data of a first chessboard for a first game interface and a control unit, and wherein each of the plurality of chessmen comprises a second electronic-paper display unit for displaying a graphical data of a first chessman which corresponds to the graphical data of the first chessboard, and the method comprising:

supplying a power to the chessboard and the plurality of chessmen when detecting a switch signal;

respectively updating the graphical data of the first chessboard displayed by the first electronic-paper display unit and the graphical data of the first chessman displayed by the second electronic-paper display unit to a graphical data of a second chessboard corresponding to a second game interface and a graphical data of a second chessman which corresponds to the graphical data of the second chessboard according to a switch signal; and stopping supplying the power to the chessboard and the plurality of chessmen after the updating has been completed, wherein each of the plurality of chessmen is physically put on the chessboard to play a game on the chessboard.

* * * * *